US010689721B2

(12) United States Patent
Nakayama et al.

(10) Patent No.: US 10,689,721 B2
(45) **Date of Patent: *Jun. 23, 2020**

(54) CASE HARDENING STEEL AND CARBURIZED COMPONENT OBTAINED THEREFROM

(71) Applicant: DAIDO STEEL CO., LTD., Nagoya-shi, Aichi (JP)

(72) Inventors: Kyohei Nakayama, Aichi (JP); Toshiyuki Morita, Aichi (JP); Keisuke Inoue, Aichi (JP)

(73) Assignee: DAIDO STEEL CO., LTD., Aichi (JP)

( * ) Notice: Subject to any disclaimer, the term of this patent is extended or adjusted under 35 U.S.C. 154(b) by 56 days.

This patent is subject to a terminal disclaimer.

(21) Appl. No.: 15/109,190

(22) PCT Filed: Jan. 23, 2015

(86) PCT No.: PCT/JP2015/051898

§ 371 (c)(1),
(2) Date: Jun. 30, 2016

(87) PCT Pub. No.: WO2015/115336

PCT Pub. Date: Aug. 6, 2015

(65) Prior Publication Data

US 2016/0333432 A1 Nov. 17, 2016

(30) Foreign Application Priority Data

Jan. 30, 2014 (JP) ..... 2014-016210

(51) Int. Cl.

| | |
|---|---|
| ***C21D 1/06*** | (2006.01) |
| ***C22C 38/00*** | (2006.01) |
| ***C22C 38/02*** | (2006.01) |
| ***C22C 38/04*** | (2006.01) |
| ***C22C 38/06*** | (2006.01) |
| ***C22C 38/42*** | (2006.01) |
| ***C22C 38/44*** | (2006.01) |
| ***C22C 38/50*** | (2006.01) |
| ***C23C 8/22*** | (2006.01) |
| ***C22C 38/60*** | (2006.01) |
| ***C23C 8/80*** | (2006.01) |
| ***C22C 38/48*** | (2006.01) |
| ***C22C 38/54*** | (2006.01) |

(52) U.S. Cl.

CPC ..... *C21D 1/06* (2013.01); *C22C 38/00* (2013.01); *C22C 38/001* (2013.01); *C22C 38/002* (2013.01); *C22C 38/02* (2013.01); *C22C 38/04* (2013.01); *C22C 38/06* (2013.01); *C22C 38/42* (2013.01); *C22C 38/44* (2013.01); *C22C 38/48* (2013.01); *C22C 38/50* (2013.01); *C22C 38/54* (2013.01); *C22C 38/60* (2013.01); *C23C 8/22* (2013.01); *C23C 8/80* (2013.01)

(58) Field of Classification Search

CPC .. C23C 8/22; C23C 8/80; C22C 38/00; C22C 38/02; C22C 38/04; C22C 38/06; C22C 38/42; C22C 38/44; C22C 38/48; C22C 38/50; C21D 1/06

See application file for complete search history.

(56) References Cited

U.S. PATENT DOCUMENTS

| | | | | |
|---|---|---|---|---|
| 6,090,225 | A | 7/2000 | Pichard | |
| 10,287,668 | B2 * | 5/2019 | Nakayama | C21D 1/06 |
| 10,428,414 | B2 * | 10/2019 | Nakayama | |
| 2014/0014234 | A1 * | 1/2014 | Okamoto | C21D 1/06 148/330 |
| 2015/0000795 | A1 * | 1/2015 | Nakayama | C21D 1/06 148/318 |
| 2016/0145732 | A1 * | 5/2016 | Nakayama | C21D 9/28 148/319 |

FOREIGN PATENT DOCUMENTS

| | | |
|---|---|---|
| CN | 105339518 A | 2/2016 |
| JP | 11-80882 A | 3/1999 |

(Continued)

OTHER PUBLICATIONS

English machine translation of JP H11-080882 A of Murai (Year: 1999).*

English machine translation of JP 2009-114484 A of Fujimatsu (Year: 2009).*

International Search Report issued with respect to Application No. PCT/JP2015/051898, dated Mar. 31, 2015.

International Preliminary Report on Patentability issued with respect to Application No. PCT/JP2015/051898, dated Aug. 2, 2016.

(Continued)

*Primary Examiner* — Scott R Kastler

*Assistant Examiner* — Jophy S. Koshy

(74) *Attorney, Agent, or Firm* — Greenblum & Bernstein, P.L.C.

(57) ABSTRACT

The present invention provides a case hardening steel which satisfies the following expression (1) representing a relationship between a maximum deformation resistance $\sigma_{MAX}$ (MPa) and a DI value, the maximum deformation resistance $\sigma_{MAX}$ (MPa) being obtained when a test piece which has a size of ϕ 15×22.5 mm and is cut out from a material after spheroidizing, is subjected to compressive deformation by cold forging at a compression ratio of 70% in a state that an end surface thereof is restrained, and the DI value being obtained from a Jominy quenching test: $\sigma_{MAX}<12.8\times DI+745$ . . . Expression (1). Additionally, the present invention obtains a carburized part by subjecting the case hardening steel to carburizing and quenching.

3 Claims, 4 Drawing Sheets

(56) References Cited

FOREIGN PATENT DOCUMENTS

| | | | |
|---|---|---|---|
| JP | H11-71613 | A | 3/1999 |
| JP | 2004-183064 | A | 7/2004 |
| JP | 2006-274373 | | 10/2006 |
| JP | 2007-31787 | A | 2/2007 |
| JP | 2009114484 | A | 5/2009 |
| JP | 2010-7120 | A | 1/2010 |
| JP | 2010-229508 | A | 10/2010 |
| JP | 2011229508 | A | 11/2011 |

OTHER PUBLICATIONS

Japanese Notifications of Reasons for Refusal from Application No. 2014-016210 dated Aug. 2, 2017.
Chinese Office Action from Application No. 2015800047763 dated Aug. 24, 2017.

* cited by examiner

PRESENT INVENTION (A) INITIAL STAGE OF CARBURIZATION (B) AFTER CARBURIZATION (C) PHOTOGRAPH OF CRYSTAL GRAINS AFTER CARBURIZATION

COMPARATIVE EXAMPLE (A) INITIAL STAGE OF CARBURIZATION (B) AFTER CARBURIZATION (C) PHOTOGRAPH OF CRYSTAL GRAINS AFTER CARBURIZATION

Fig. 2(III)
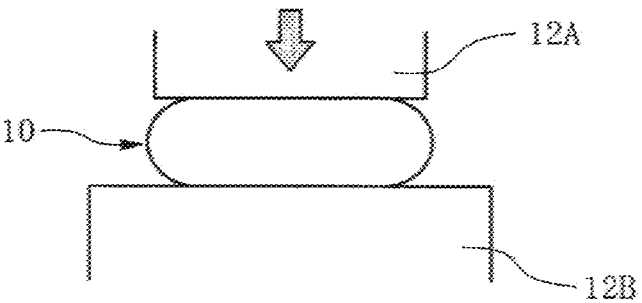

CASE HARDENING STEEL AND CARBURIZED COMPONENT OBTAINED THEREFROM

TECHNICAL FIELD

The present invention relates to a case hardening steel having an excellent cold forgeability and hardenability, and relates to a carburized part using the same.

BACKGROUND ART

As one method for working a steel material into shapes of gears and other parts, hot forging of forging a steel material at a high temperature is widely used.

However, in hot forging, it is required to heat a material to be forged at a high temperature and also required to heat a die. Thus, there is a problem of an increase in required costs since a large amount of thermal energy is consumed and the number of working steps is increased.

The working method has been changed from hot forging to cold forging. In cold forging, heating is not required and the number of working steps is decreased. Thus, it is possible to reduce required costs.

However, since the deformation resistance of a material to be forged increases in cold forging as compared to hot forging, there are significant problems of abrasion or cracking of a die.

In order to solve this problem, a countermeasure of reducing deformation resistance at the time of forging working by decreasing the hardness of a material (steel material) through inhibition of addition of an alloy element, and the like have been conventionally taken.

However, reduction in hardness and deformation resistance through reduction of addition of an alloy element causes a decrease in the strength of parts.

Incidentally, for example, gears are produced for using, by forming steel into shapes of parts normally by cutting, forging, and the like, then subjecting the steel to carburizing and quenching for improving abrasion resistance and fatigue strength, and subjecting the steel to a surface treatment.

Conventionally, as quenching at the time of carburization, oil quenching has been a main stream. In recent years, however, quenching by gas cooling in a small carburizing furnace has been performed in some cases. Quenching by gas cooling is advantageous in that the amount of distortion at the time of gas quenching is smaller than the amount of distortion at the time of conventional oil quenching.

However, since the cooling rate of gas cooling is lower than the cooling rate of oil cooling, in order to obtain hardness that can ensure strength, it is required to add a large amount of an alloy element. When a large amount of an alloy element is added to improve hardenability, the hardness of the steel material increases and thus the aforementioned cold forgeability is deteriorated.

That is, cold forgeability and hardenability are conventionally in a trade-off relationship and there are technical difficulties in attaining both properties.

In addition, Patent Document 1 below discloses the invention relating to a "case hardening steel material having excellent cold workability and coarse grain preventing properties at the time of carburization and method for producing the same" and it is disclosed therein that the amount of Cr is limited to 1.25% or less to ensure cold workability, B is added to ensure hardenability, and for the purpose of preventing abnormal grain growth of crystal grains, the amount of precipitate particles of Ti and Nb is defined such that the density of precipitate particles of TiC and NbC having a diameter of 0.2 μm or less is 10 particles/$\mu m^2$ or more.

Patent Document 1 is different from the present invention in that a large amount of Ti is added to precipitate TiC (a balance between Ti and N is different from that of the present invention), and Nb which is considered as an impurity component in the present invention is added.

BACKGROUND ART DOCUMENT

Patent Document

Patent Document 1: JP-A-2004-183064

SUMMARY OF THE INVENTION

Problems that the Invention is to Solve

The present invention has been made based on the above-mentioned circumstances as background, and an object thereof is to provide a case hardening steel which has an excellent cold forgeability and is capable of improving required hardenability to make carburizing and quenching by gas quenching (gas cooling) possible, and a carburized part using the same.

Means for Solving the Problems

The present invention relates to the following [1] to [7].

[1] A case hardening steel which satisfies the following expression (1) representing a relationship between a maximum deformation resistance $\sigma_{MAX}$ (MPa) and a DI value, the maximum deformation resistance $\sigma_{MAX}$ (MPa) being obtained when a test piece which has a size of ϕ 15×22.5 mm and is cut out from a material after spheroidizing, is subjected to compressive deformation by cold forging at a compression ratio of 70% in a state that an end surface thereof is restrained, and the DI value being obtained from a Jominy quenching test:

$$\sigma_{MAX}<12.8\times DI+745 \quad \text{Expression (1).}$$

[2] A carburized part obtained by working a case hardening steel into a shape of a part by cold forging, followed by subjecting to carburizing and quenching, the case hardening steel satisfying the following expression (1) representing a relationship between a maximum deformation resistance $\sigma_{MAX}$ (MPa) and a DI value, the maximum deformation resistance $\sigma_{MAX}$ (MPa) being obtained when a test piece which has a size of ϕ 15×22.5 mm and is cut out from a material after spheroidizing, is subjected to compressive deformation by cold forging at a compression ratio of 70% in a state that an end surface thereof is restrained, and the DI value being obtained from a Jominy quenching test:

$$\sigma_{MAX}<12.8\times DI+745 \quad \text{Expression (1),}$$

in which a total amount of TiC, AlN and ZrC, which are precipitate particles, is $4.5\times10^{-10}$ moles or less per 1 $mm^2$ of grain boundary area of prior austenite grains after the carburizing and quenching.

[3] The carburized part according to [2], in which the carburizing and quenching is carburizing and quenching performed using gas quenching.

[4] The carburized part according to any of [2] and [3], in which, in a structure thereof after the carburizing and quenching, an average crystal grain size number of the prior austenite grains is No. 6 or less.

[5] The carburized part according to any of [2] to [4], which is formed by working the case hardening steel into a shape of a part by cold forging, followed by subjecting to carburizing and quenching, the case hardening steel having a composition including, in terms of % by mass:

0.10% to 0.30% of C;
0.01% to 1.50% of Si;
0.40% to 1.50% of Mn;
0.01% to 0.10% of S;
0.03% or less of P;
0.05% to 1.00% of Cu;
0.05% to 1.00% of Ni;
0.01% to 2.00% of Cr;
0.01% to 0.50% of Mo;
0.001% or less of Nb;
0.005% to 0.050% of s-Al;
0.005% to 0.030% of N;
0.001% to 0.150% of Ti; and
0.000% to 0.300% of Zr,
with the remainder being Fe and inevitable impurities, in which [Ti], [Zr] and [N] which respectively represent contents of Ti, Zr and N satisfy the following expression (2):

$$|[Ti]/47.9+[Zr]/91.2-[N]/14|/100 \leq 3.5\times10^{-6}\ \text{mol/g} \quad \text{Expression (2).}$$

[6] The carburized part according to any of [2] to [4], which is formed by working the case hardening steel into a shape of a part by cold forging, followed by subjecting to carburizing and quenching, the case hardening steel having a composition including, in terms of % by mass:

0.10% to 0.30% of C;
0.01% to 1.50% of Si;
0.40% to 1.50% of Mn;
0.01% to 0.10% of S;
0.03% or less of P;
0.05% to 1.00% of Cu;
0.05% to 1.00% of Ni;
0.01% to 2.00% of Cr;
0.01% to 0.50% of Mo;
0.001% or less of Nb;
0.001% to 0.008% of s-Al;
0.005% to 0.030% of N;
less than 0.001% of Ti; and
less than 0.001% of Zr,
with the remainder being Fe and inevitable impurities.

[7] The carburized part according to any of [5] and [6], in which the case hardening steel further includes, in terms of % by mass:

0.001% to 0.010% of B.

Advantage of the Invention

According to the present invention, it is possible to provide a case hardening steel which has an excellent cold forgeability and is capable of improving hardenability required to make carburizing and quenching by gas cooling possible, and a carburized part using the same.

BRIEF DESCRIPTION OF THE DRAWINGS

FIG. 1(*b*) is a comparative example diagram shown for illustrating formation of abnormal grain growth.

MODE FOR CARRYING OUT THE INVENTION

Figure 1A:
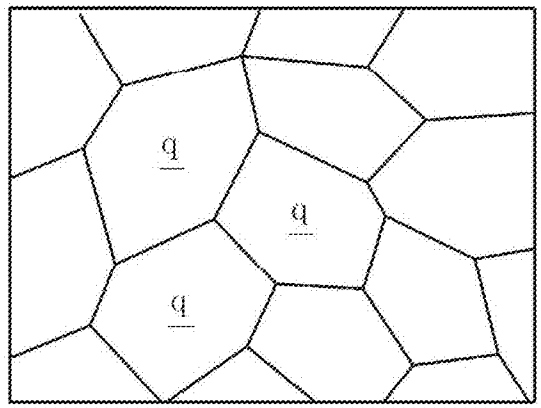
FIG. 1(*a*) is a schematic model diagram showing change behavior of crystal grains when the number of pinning particles (precipitate particles) is minimized.
Figure 1A:
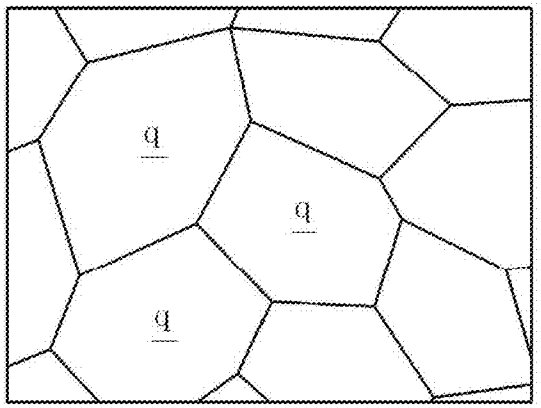
Figure 1A:
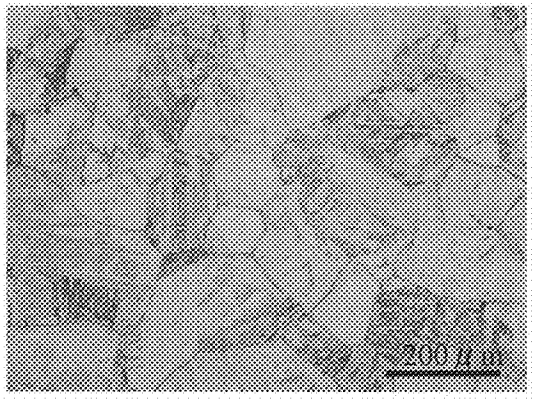
Figure 1B:
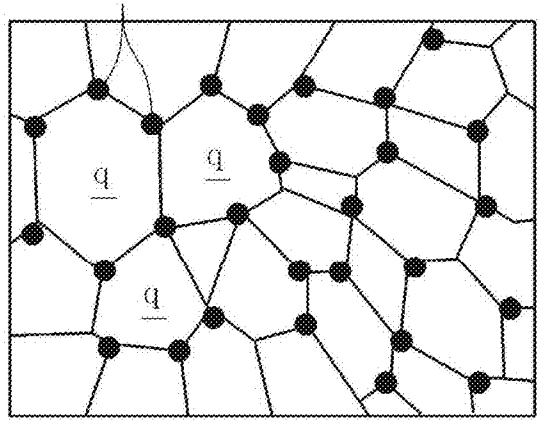
Figure 1B:
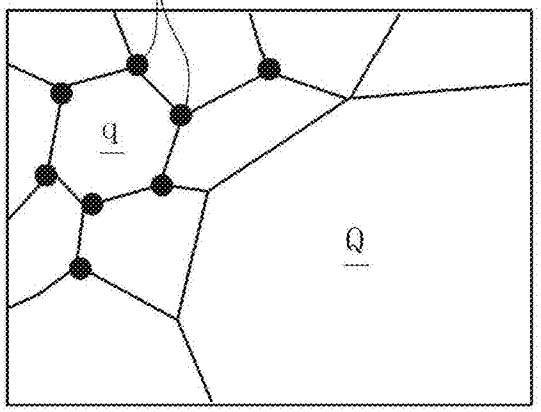
Figure 1B:
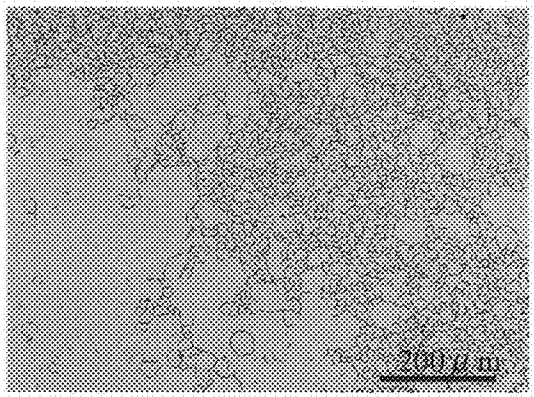

In the above-mentioned [1], an ideal critical diameter (DI) value is an index for expressing hardenability.

In the present invention, this DI value is determined based on a result of a Jominy quenching test defined by JIS G 0561 (2011).

Specifically, first, a JI value is obtained by the Jominy quenching test. Here, the JI value is determined as hardness at 50% martensite.

In the Jominy quenching test, the lower end surface of a columnar test piece in a state that the test piece is heated to a predetermined quenching temperature is cooled by a water jet and quenched. Then, the side surface thereof is cut so as to have a flattened surface having a predetermined thickness, and the hardness (HRC) at a position of a height of 1.5 mm from the lower end surface is measured. The JI value is obtained from the hardness at a height of 1.5 mm (position) in the following manner.

JI=1.5 mm position hardness (HRC)-12 (HRC)

The thus-obtained JI value is substituted into the following expression to calculate a DI value.

$$DI = 232\times\left(\frac{JI}{JI+18.8}\right)^{1.24} \quad \text{[Math. 1]}$$

On the other hand, a maximum deformation resistance $\sigma_{MAX}$ is an index for expressing forgeability when cold forging is performed. As this value decreases, cold forgeability becomes more satisfactory. In contrast, as this value increases, cold forgeability becomes poorer.

In general, in order to improve the hardenability of a steel material, as described above, a large amount of an alloy element related to quenching is added. At this time, the DI value of the steel material is increased.

At the same time, the cold forgeability of the steel material is deteriorated and the above-mentioned $\sigma_{MAX}$ value becomes large. That is, both the DI value and the $\sigma_{MAX}$ value are increased.

In addition, the contents of JIS G 0561 (2011) are incorporated herein by reference.

Further, the "ϕ" refers to a diameter.

In the present invention, a steel material (case hardening steel) in which the DI value and the $\sigma_{MAX}$ value satisfy the relationship of the expression (1) is used when a carburized part is manufactured therefrom.

In this case hardening steel, even when the hardenability is increased by increasing the DI value, the maximum deformation resistance $\sigma_{MAX}$ is maintained at a low value of a predetermined level or less. Accordingly, both properties of satisfactory cold forgeability and satisfactory hardenability can be ensured and while a part can be formed by cold forging, hardenability required for performing quenching by gas cooling at the time of carburizing treatment can be improved.

Here, gas cooling means a method of spraying a non-oxidizing gas such as an inert gas such as nitrogen and argon gas onto a target to cool the target.

In the present invention, the total precipitated amount of TiC, AlN and ZrC is $4.5\times10^{-10}$ moles or less per 1 $mm^2$ of grain boundary area of prior austenite grains after carburization, and the pinning of crystal grain boundaries by precipitate particles at the time of carburization is avoided as much as possible, thereby decreasing the grain size number of crystal grains, that is, the DI value can be increased by coarsening crystal grains and also cold forgeability can be increased.

A technique of pinning grain boundaries by precipitating particles such as AlN in a dispersed state at a manufacturing step before a carburizing treatment is widely used for preventing crystal grains from becoming coarse.

However, such techniques which allow pinning of grain boundaries by utilizing precipitate particles of this kind are incapable of sufficiently preventing an abnormal grain growth in which abnormal coarsening of crystal grains occurs locally.

The term "abnormal grain growth" used herein refers to a phenomenon occurring due to a cause that, though a pinning force of precipitate particles is greater than a driving force for crystal grain growth in the initial carburizing stage, the magnitude relation between these forces comes to reverse and the driving force for crystal grain growth becomes greater than the pinning force of precipitate particles in the middle of the carburizing. Such a reversal of these forces takes place through a cause that the pinning force is reduced by solid solution formation of precipitate particles during the carburizing, by coarsening of precipitates through Ostwald growth, and the like.

In addition, as to the parts which are subjected to cold forging, a distribution of plastic distortions is introduced into the inside of the parts at the time of the forging, and a reversal of magnitude takes place between the pinning force and driving force of crystal grain growth in regions where the distortion is great, thereby causing abnormal grain growth of crystal grains.

FIG. 1(*b*) shows the occurrence of abnormally grown grains model-wise.

(A) of FIG. 1(*b*) shows a state at the initial stage of carburization, and p represents a precipitate particle (a pinning particle). In the state at the initial stage of carburization, a large number of precipitate particles p are interposed between grain boundaries, and the grain boundaries between crystal grains q are pinned and restrained, thereby inhibiting the crystal grains q from growing to a larger size.

However, some of the precipitate particles p pinning grain boundaries disappear by forming a solid solution during carburization, and the pinning (restraint) by such precipitate particles p is broken (comes undone), and some adjacent pairs of crystal grains thus made free from the pinning at the grain boundaries coalesce and grow into one crystal grain.

Crystal grains which have increased in size in such a manner can gain power for grain growth, and under a relative reduction in the pinning force of precipitate particles p, each crystal grain breaks the pinning of grain boundaries by the precipitate particles p and swallows one neighboring crystal grain after another, thereby continuing the grain growth.

That is, once the grain boundary pinning by precipitate particles p has been broken, the pinning-broken crystal grain boundaries function as the center of grain growth, and from such grain boundaries, the grain growth of the crystal grain occurs chain-reactionally to develop into abnormal grain growth and finally abnormally form giant crystal grains Q as shown in (B) of FIG. 1(*b*).

(C) of FIG. 1(*b*) shows an example of abnormally-grown grains (a photograph of crystal grains after carburization).

When such abnormal grain growth occurs, heat treatment distortion develops due to local improvement of hardenability and thus causes problems of making noises and vibrations or reducing the fatigue strength.

Conventionally, in such a case, measures have been taken so that greater precipitate particles are precipitated in a dispersed state to further improve the power of grain boundary pinning by the precipitate particles. However, occurrence of the abnormal grain growth cannot be sufficiently prevented by such measures.

In addition, when a large amount of precipitate particles is precipitated in a dispersed state as described above, the precipitate particles themselves are one cause of increasing deformation resistance at the tune of cold forging.

Particularly, in recent years, the use of a technique of raising carburization temperatures to reduce the carburizing time, a technique of performing cold forging for reduction of manufacturing costs of parts and techniques adaptable to environmental protection, such as vacuum carburization performed to reduce emissions of $CO_2$ in the middle of manufacturing and to improve the strength have been widespread. However, the abnormal grain growth has been more likely to occur under these techniques.

In the above-mentioned [2], since the density of precipitate particles is minimized by limiting the total amount of TiC, AlN and ZrC, which are precipitate particles, to $4.5\times10^{-10}$ moles or less per 1 $mm^2$ of grain boundary area of prior austenite grains after carburization, a state of "pinning force of precipitate particles<driving force for crystal grain growth" is achieved from the initial stage of carburization.

Hereinafter, this point will be described based on the model diagram of FIG. 1(*a*).

In the model diagram of FIG. 1(*a*) (which is, for convenience of understanding, presented on the assumption that there is no precipitation of precipitate particles), individual crystal grains q are almost the same in size and are in contact with one another along the respective crystal grain boundaries in the initial stage of carburization of (A).

Thereafter, in the technique of pinning crystal grain boundaries by precipitate particles in the background art, as described above, some of the precipitate particles are solid-solved to disappear during the carburization, and thus the abnormal grain growth occurs in which a certain crystal grain continues to exceptionally grow so as to become coarse, whereby the giant grain is formed.

In contrast to such a result, in the case of model diagram of FIG. 1(*a*) according to the present invention, since there is no restraint, or no pinning, of crystal grain boundaries by precipitate particles from the beginning of carburization, there is a tendency for crystal grains q to freely grow without undergoing the pinning action of precipitate particles during the carburization.

However, all the crystal grains q are the same in a point of having a tendency to freely grow without undergoing the pinning action of precipitate particles. As a result, each crystal grain q receives grain growth pressure of other crystal grains around itself as pressure for inhibition of grain growth. As a result, it is not possible for any of crystal grains q to grow exceptionally and all crystal grains q are confined to growth equally to some extent.

As a result, despite the absence of precipitate particles to stop the grain growth (if anything, for just the reason why such precipitate particles are absent), individual crystal grains q are confined to slight growth to the same extent as one another, and it becomes possible to effectively inhibit the abnormal growth of any specific crystal grain among the crystal grains q from occurring exceptionally.

Incidentally, (C) of FIG. 1(*a*) shows a photograph of a sample in which abnormal grain growth has been inhibited by minimizing precipitation of precipitate particles (a photograph of crystal grains after carburization).

In addition, a point that abnormal gain growth is prevented and individual grains grow uniformly by minimizing the number of precipitate particles is disclosed in Japanese Patent Application No. 2013-134262 and Japanese Patent Application No. 2013-134263 (both have not been published) which are the applications by the applicant of the present application.

As described above, in the above-mentioned [2], by minimizing precipitation of precipitate particles, crystal grains grow uniformly while abnormal gain growth is prevented. Thus, by reducing deformation resistance, cold forgeability is increased and hardenability is also increased. By minimizing the number of precipitate particles, the precipitate particles themselves are prevented from being a cause of increasing deformation resistance at the time of cold forging and thus cold forgeability is improved.

According to the studies by the inventors, it has been found that crystal grain growth under the state that abnormal grain growth is prevented can be achieved by minimizing the density of precipitate particles in steel so that the total amount of TiC, AlN and ZrC, which are precipitate particles, becomes $4.5\times10^{-10}$ moles or less per 1 $mm^2$ of the grain boundary area of prior austenite grains after carburization.

In the present invention, the reasons for limiting the total amount of TiC, AlN and ZrC, which are precipitate particles, per unit area of 1 $mm^2$ of the grain boundary area of prior austenite grains are as follows.

First, the pinning effect by precipitate particles varies depending on the grain boundary area and as the grain boundary area increases, a large number of precipitate particles are required. In contrast, as the grain boundary area decreases, the number of precipitate particles may become smaller.

Second, the amount of precipitate particles is merely an amount of precipitate particles measured in a carburized part, and the amount of precipitate particles includes precipitate particles present at prior austenite grain boundaries and precipitate particles absent at prior austenite grain boundaries. Here, as the amount of precipitation increases, the amount of precipitate particles present at grain boundaries also naturally increases.

Third, the amount of precipitate particles at crystal grain boundaries is important in the present invention. However, when the total amount of precipitate particles is large, the amount of precipitate particles present at crystal grain boundaries also increases and thus the total amount of precipitate particles is converted and arranged into an amount per unit area of prior austenite grains, whereby an effect on pinning by precipitate particles can be determined.

In the present invention, for the above-mentioned carburizing and quenching, carburizing and quenching using gas quenching can be used (the above-mentioned [3]).

In this case, distortion generating along with the carburizing and quenching can be reduced.

In the present invention, the average crystal grain size number of prior austenite grains in the structure after the carburizing and quenching can be set to be No. 6 or less (the above-mentioned [4]).

In this manner, the average crystal grain size number before carburization can be reduced, that is, the size of the crystal grains can be increased, and thus, cold forgeability and hardenability can be improved.

In the present invention, a carburized part can be obtained using a steel material (case hardening steel) having the chemical composition defined in the above-mentioned [5].

In the case hardening steel having the chemical composition defined in the above-mentioned [5], the density of precipitate particles acting on the pinning of crystal grain boundaries can be minimized by controlling the contents of Ti, Zr and N so as to satisfy the above expression (2).

Specifically, for example, by adding Ti and Zr to the steel, TiN and ZrN having no contribution to the pinning of crystal grain boundaries are crystallized by combination of Ti and Zr with N included in the steel at the time of casting the steel, and AlN having a pinning action is prevented from being precipitated through the combination of N in the steel with Al.

However, when excessive amounts of Ti and Zr is added, precipitation of TiC and ZrC is caused to result in formation of precipitate particles having a pinning action, and thus it is important to control amounts of these elements so as not to be excessive and so as to satisfy the expression (2).

In short, the expression (2) has the following meaning.

That is, in any of two cases of a case where a large amount of N convertible into AlN by the reaction with Al in steel is present in the steel and a case where large amounts of Ti and Zr convertible into TiC and ZrC by the reaction with C in steel are present, undesirable amounts of precipitate particles are formed in steel. Therefore, Ti and Zr are made to crystallize with N in steel into crystallized products at the time of solidification, whereby N, Ti and Zr which are capable of forming precipitate particles are fixed (consumed), and hence it follows that redundant Ti, Zr and N are defined by the expression (2) and the value thereof is controlled to a target value of $3.5\times10^{-6}$ mol/g or less.

However, it is also possible to minimize the density of precipitate particles acting on pinning of crystal grain boundaries by adopting the chemical composition defined in the above-mentioned [6] into a steel material used for carburized parts.

Specifically, in the above-mentioned [6], with the addition of Ti and Zr for consuming N in steel by forming crystallized products in an amount of less than 0.001% respectively, preferably with no addition of Ti and Zr, the added amount of s-Al which forms precipitate particles is made minute, and thus the density of precipitate particles is minimized.

In addition, in the present invention, the steel material can include, in terms of % by mass, B: 0.001% to 0.010% as an optional component (the above-mentioned [7]).

In the present invention, the grain boundary area of prior austenite grains and the amounts of TiC, AlN and ZrC precipitated can be obtained as follows.

(Method for Obtaining Grain Boundary Area)

The surface of a carburized product is vertically cut and a sample for observation is cut out from the carburized product. The section including the surface is polished to make prior austenite grain boundaries appear. Then, an average crystal grain size n is measured according to the method defined in JIS G 0551 (1998) (when the average crystal grain size is measured, measurement may be performed including the surface (carburized layer)). Thus, a prior austenite grain radius r is calculated by the following expression.

$$r=(3/2\times1/(2^{(n+3)}\times\pi))^{0.5} \quad \text{Expression (3)}$$

In addition, the expression (3) is obtained as follows.

A relationship between the number of crystal grains m per unit area (1 $mm^2$) in JIS G 0551 (1998) and the average crystal grain size n satisfies $m=2^{(n+3)}$. From this relational expression, on the assumption that prior austenite grains has a spherical shape having a radius r, the sectional area of the crystal grains is $\pi r^2=3/2\times1/m=3/2\times1/(2^{(n+3)})$. Thus, the radius r can be expressed by the expression (3).

Here, the coefficient of "3/2" is a coefficient which is determined in consideration that the measured section is generally shifted from the center of the crystal grain.

In addition, the contents of JIS G 0551 (1998) are incorporated herein by reference.

The grain boundary area can be expressed by the following expression (4) using the radius r.

Grain boundary area=number of prior austenite grains included in unit mass (1 g) of steel material)×surface area of one prior austenite grain×1/2=$(1000/7.8)/(4/3\times\pi\times r^3)\times4\pi r^2\times1/2$ Expression (4)

Here, "(1000/7.8)" is a reciprocal of the density of the steel and "1/2" is a coefficient which is determined in consideration that neighboring crystal grains are in contact with one another.

Accordingly, by the above expressions (3) and (4), the grain boundary area of prior austenite can be obtained by measuring the average crystal grain size n.

(Quantitation Method of Tic)

Extraction of all precipitates is performed according to an electrolytic method using a methanol solution containing 10% acetyl acetone and 1% tetramethylammonium chloride (10% AA solution). After electrolysis, suction filtration is performed using a Nuclepore Filter with a pore size of 0.2 μm, and a portion of the residue obtained is changed to a solution by fusion based on a mixed acid decomposition, and then metallic element components in all the precipitates are quantitated by ICP optical emission spectroscopy, thereby determining an amount of Ti precipitates per predetermined mass and further converting the amount into an amount per unit gram. Another portion of the residue obtained is subjected to an immersion treatment in a methanol solution containing 10% bromine, thereby extracting only TiN as a residue, quantitaing the amount of TiN per predetermined mass by mass measurement, and converting the amount into an amount per unit gram. Then, the amount of TiC (amount of TiC per unit gram) is determined from the following expression.

Amount of TiC=(amount of total Ti precipitates)−(amount of TiN).

(Quantitation Method of ZrC)

Quantitation of ZrC is made using the same method as in the quantitation of TiC.

(Quantitation Method of AlN)

A portion of the residue left after dissolving a matrix in a methanol solution containing 14% iodine is subjected to quantitation of total Al (AlN and $Al_2O_3$) per unit gram according to ICP optical emission spectroscopy. In addition, when another portion of the residue is subjected to acid decomposition using sulfuric acid, whereby the nitride and the oxide are separated, the oxide is left in the residue. The Al quantitation by elemental analysis can be translated into $Al_2O_3$ quantitation. Accordingly, the amount of AlN can be determined from the following expression:

Amount of AlN=total amount of Al components (AlN and $Al_2O_3$)−amount of $Al_2O_3$.

From the grain boundary area and the amount of precipitates determined by the above method, the amount of precipitates per 1 $mm^2$ of prior austenite grain boundary can be obtained by the following expression:

Amount of precipitates per 1 $mm^2$ of prior austenite grain boundary=(amount of precipitates)/(area of prior austenite grain boundary)

The reasons for limiting individual chemical components and the like in the present invention will be described below. Herein, "%" in the composition of each chemical component refers to "% by mass".

C: 0.10% to 0.30%

C is contained in an amount of 0.10% or more from the viewpoint of ensuring hardness and strength. However, when C is contained in an excessive amount of more than 0.30%, workability is deteriorated when a steel material is worked into shapes of parts like gears by cold forging. Thus, the upper limit of the C content is 0.30%.

Si: 0.01% to 1.50%

It is necessary that Si is contained in an amount of 0.01% or more from the viewpoint of ensuring hardenability and strength. However, when Si is contained in an excessive amount of more than 1.50%, forgeability and machinability are deteriorated and thus the upper limit of the Si content is 1.50%.

Mn: 0.40% to 1.50%

Mn is contained in an amount of 0.40% or more from the viewpoint of controlling the shape of inclusions such as MnS and ensuring hardenability. In addition, when Mn is contained in an amount of lower than 0.40%, Mn induces formation of ferrite at the core, whereby strength is decreased. Thus, in this sense, Mn is contained in an amount of 0.40% or more. However, when Mn is contained in an excessive amount of more than 1.50%, machinability is deteriorated. Therefore, the upper limit of the Mn content is 1.50%.

S: 0.01% to 0.10%

S is contained in an amount of 0.01% or more from the viewpoint of ensuring machinability. However, when S is contained in an excessive amount of more than 0.10%, strength is decreased. Thus, the upper limit of the S content is 0.10%.

P: 0.03% or Less

In the present invention, P is an impurity component which causes reduction in strength, and the P content is limited to 0.03% or less.

Cu: 0.05% to 1.00%

Cu is effective for ensuring hardenability when the content thereof is 0.05% or more. On the other hand, when Cu is contained in an excessive amount of more than 1.00%, cold workability is deteriorated. Thus, the upper limit of the Cu content is 1.00%.

Ni: 0.05% to 1.00%

Ni is effective for ensuring hardenability when the content thereof is 0.05% or more. On the other hand, when Ni is contained in an excessive amount of more than 1.00%, the amount of carbide precipitates is reduced, whereby lowering of strength is caused. Thus, the upper limit the Ni content is 1.00%.

Cr: 0.01% to 2.00%

Cr is an element effective for improving hardenability and improving strength and is therefore contained in an amount of 0.01% or more. However, when Cr is contained in an excessive amount of more than 2.00%, workability, particularly, machinability is deteriorated. Thus, the upper limit of the Cr content is 2.00%.

Mo: 0.01% to 0.50%

Mo is an element which improves strength, and is therefore contained in an amount of 0.01% or more. In the case where a greater effect on improvement of strength by the addition of Mo is desired, it is preferred that Mo is contained in an amount of 0.15% or more. However, when Mo is contained in an excessive amount of more than 0.50%, workability is deteriorated and costs also increase. Thus, the upper limit of the Mo content is 0.50%.

Nb: 0.001% or Less

In the present invention, Nb is an impurity element. When Nb is present, NbC precipitates and pins crystal grain boundaries. Thus, the Nb content is controlled to 0.001% or less.

s-Al: 0.005% to 0.050% (the above-mentioned [5]) or 0.001% to 0.008% (the above-mentioned [6])

Al is incorporated into the steel for use as a deoxidizer. In the above-mentioned [5], the s-Al content is limited to be within a range of 0.005% to 0.050%.

On the other hand, in the above-mentioned [6], the upper limit of s-Al content is controlled to 0.008% or less in order to prevent formation of AlN since Zr and Ti as components in the steel are contained in an amount of less than 0.001% respectively, or Zr and Ti are preferably not contained in the steel.

s-Al means acid soluble aluminum and can be quantitated by the method defined in JIS G 1257 (1994), Appendix 15. In addition, the contents of JIS G 1257 (1994) are incorporated herein by reference.

N: 0.005% to 0.030%

Ti: 0.001% to 0.150% (the above-mentioned [5]), <0.001% (the above-mentioned [6])

Zr: 0.000% to 0.300% (the above-mentioned [5]), <0.001% (the above-mentioned [6])

Each of these N, Ti, and Zr minimizes the precipitation density of harmful precipitate particles by interactions with one another. The minimization conditions are within ranges satisfying the expression (2) in above-mentioned [5].

In addition, in the above-mentioned [6], respective contents are within ranges required for minimization of the precipitation density of harmful precipitate particles in the same manner.

Further, in the above-mentioned [5], the expression (2) can be satisfied by containing only Ti among Ti and Zr. In this case, Zr is not required to be contained. That is, in the above-mentioned [5], Zr is an optional component and the content is within a range including 0.000%.

B: 0.001% to 0.010%.

B is an element which improves hardenability and 0.001% or more of B can be contained as required. However, when the content thereof is more than 0.010%, precipitates of B are formed at grain boundaries to reduce strength.

Total Amount of TiC, AlN and ZrC which are Precipitate Particles: $4.5\times10^{-10}$ Mole or Less A total amount of TiC, AlN, and ZrC, which are precipitate particles, is $4.5\times10^{-10}$ mole or less per 1 $mm^2$ of grain boundary area of prior austenite grains in a part after carburization. This is important because the formation of precipitate particles from the initial stage of carburization is minimized, thereby preventing crystal grain boundaries from being substantially restrained by pinning by the precipitate particles or weakening the pinning force to allow the crystal grain growth while abnormal gain growth is prevented.

EXAMPLES

Each of steel materials having chemical compositions shown in Table 1 was melted, maintained for 4 hours under heating at 1,250° C., and then subjected to hot rolling at a temperature of 950° C. or higher, thereby being formed into columnar test pieces and steel bars having a diameter ϕ of 30 mm for a Jominy quenching test defined in JIS G 0561 (2011).

Each of the test pieces for the Jominy quenching test was used and subjected to the Jominy quenching test to obtain a DI value.

In addition, each of the steel bars having a diameter ϕ of 30 mm was used and the following various tests including a forging test were performed.

Typically, since a part to be subjected to cold forging is subjected to a softening heat treatment before the forging, a softening treatment in which the steel bar was maintained at 760° C. for 4 hours, and then the temperature was lowered to 650° C. at 15° C./h and underwent air-cooling was then performed, and the hardness after the softening treatment (Rockwell hardness HRB) was measured.

Figure 2I:
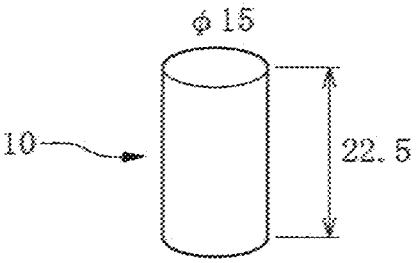
FIGS. 2(I) to 2(III) are diagrams for illustrating a step of cold forging in Examples.
Figure 2:
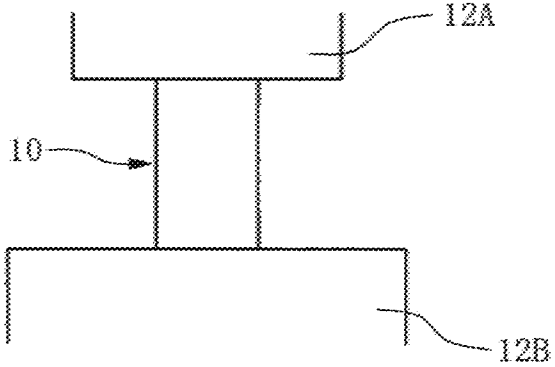

In addition, a test piece 10 for cold forging (refer to FIG. 2(I)) having a size of 4) 15×22.5 Lmm was prepared from the steel bar which had been subjected to the softening heat treatment. The test piece 10 was subjected to cold forging by using a pair of forging dies 12A and 12B, bringing the forging dies 12A and 12B into contact with each end surface of the test piece 10, and pressing the test piece 10 as shown in FIGS. 2(II) and 2(III) at a compression ratio of 70% and a reduction rate (distortion rate) of 6.7 (1/S) in a state that the end surface is restrained, and the maximum deformation resistance was measured. The maximum deformation resistance was obtained by performing the test at n=3 for each steel and averaging the obtained values.

Next, the cold-forged test piece was subjected to carburizing and quenching at 950° C. and the hardness and the crystal grain size of prior austenite grains were measured.

The carburization conditions are such that the test piece was maintained at a temperature of 950° C. and carbon potential (CP) of 0.8% for 2 hours and then maintained at 850° C. and CP of 0.8% for 0.5 hours. Thereafter, the test piece was subjected to quenching (oil quenching) in oil at 80° C. and gas cooling (cooling by gas blowing), that is, gas quenching, and the hardness (HRC) after the respective quenching was measured.

In addition, a $N_2$ gas was used as a cooling gas in the gas cooling and the gas was blown to a target by a cooling fan under conditions that the gas pressure was 9 bar and the number of revolutions of the cooling fan was 60 Hz.

Further, the hardness was measured by cutting the test piece which was subjected to cold forging and carburizing and quenching so as to obtain a cross section, measuring the hardness of a R/2 (R: radius) portion at 4 points at intervals of 90° in a circumferential direction using a Rockwell hardness meter, and obtaining the average value thereof.

On the other hand, for crystal in observation, the test piece (which was subjected to a carburizing and quenching treatment performed by oil quenching after cold forging) was cut in half so as to obtain a vertical section, the section thereof was mirror-polished, then the polished section was etched with a saturated picric acid solution, whereby prior austenite grain boundaries appeared. Then, the crystal grain size was measured. The measurement was performed at the center portion of the vertical section and a method defined in JIS G 0551 (1998) was used as the measurement method. The observation was performed for 5 view fields using an optical microscope at a magnification of 100 times and the average value was obtained.

In addition, regarding Examples 1, 6, and 11, in order to confirm the stability of crystal grain size, carburization was also performed at 1,050° C. and the crystal grain size was measured.

In addition, the carburizing treatment was performed at 1,050° C. under the same conditions as the above-mentioned conditions (the quenching was oil quenching) except that carburization was performed at 1,050° C. instead of carburization at 950° C.

There is no great difference in crystal grain size between the carburization at 1,050° C. and the carburization at 950° C. and parts prepared from the steel materials of Examples have stable crystal grain size properties even at a high temperature.

In addition, for the test piece which was subjected to the carburizing treatment (the quenching was oil quenching) under the condition of the temperature of 950° C., the amounts (mole) of TIC, AlN and ZrC which are precipitate particles included in the steel materials were quantitated by the above-mentioned methods and converted into amounts per 100 g of steel material. Further, the grain boundary area ($mm^2$) of prior austenite grains per 1 g of steel material obtained from the measured average crystal grain size n of the prior austenite grains was converted into area per 100 g of steel material. Thus, an amount of precipitate particles per 1 $mm^2$ of grain boundary area of prior austenite grains was calculated from these values.

Figure 3:
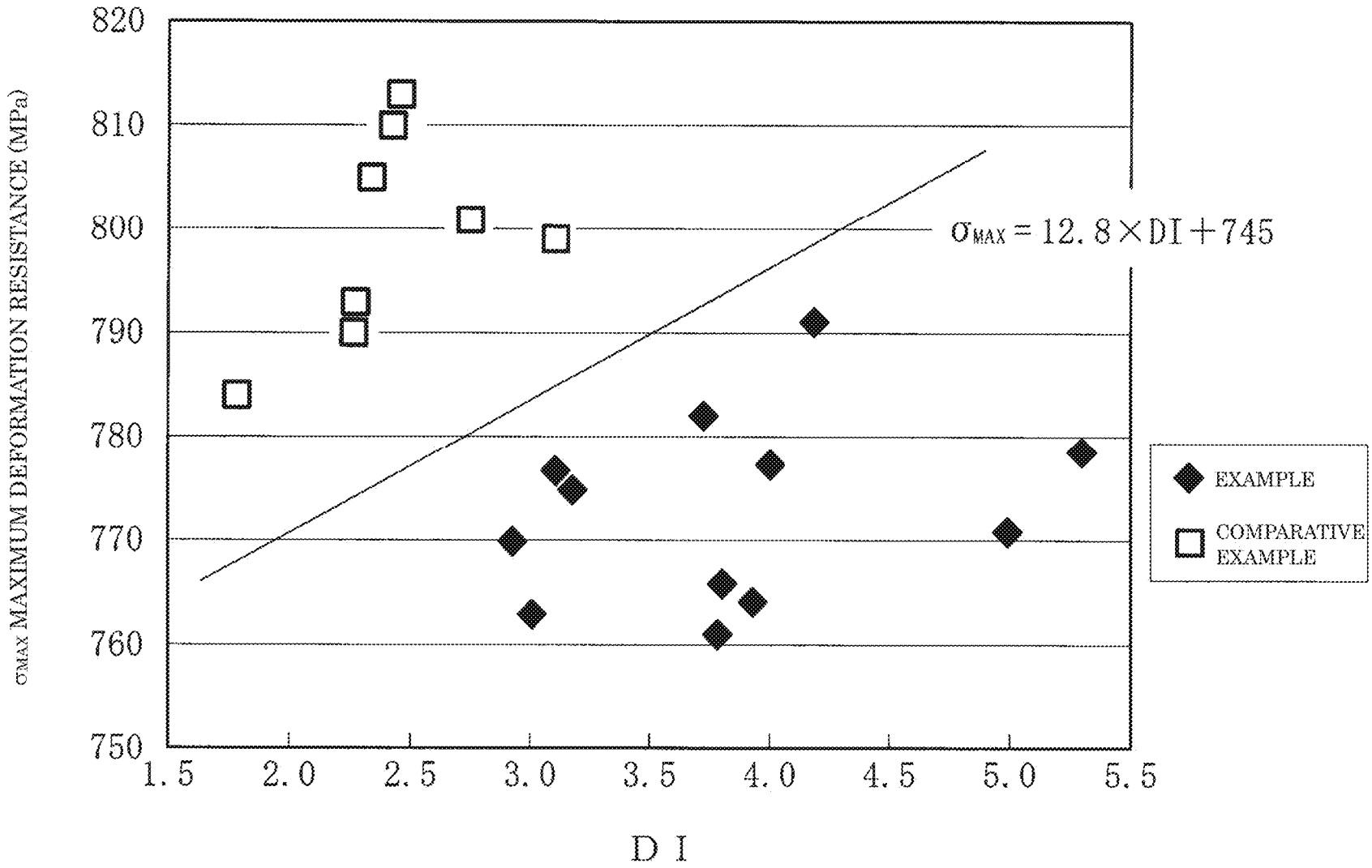
FIG. 3 is a diagram showing a relationship between a DI value and a maximum deformation resistance in Examples and Comparative Examples.
Figure 4:
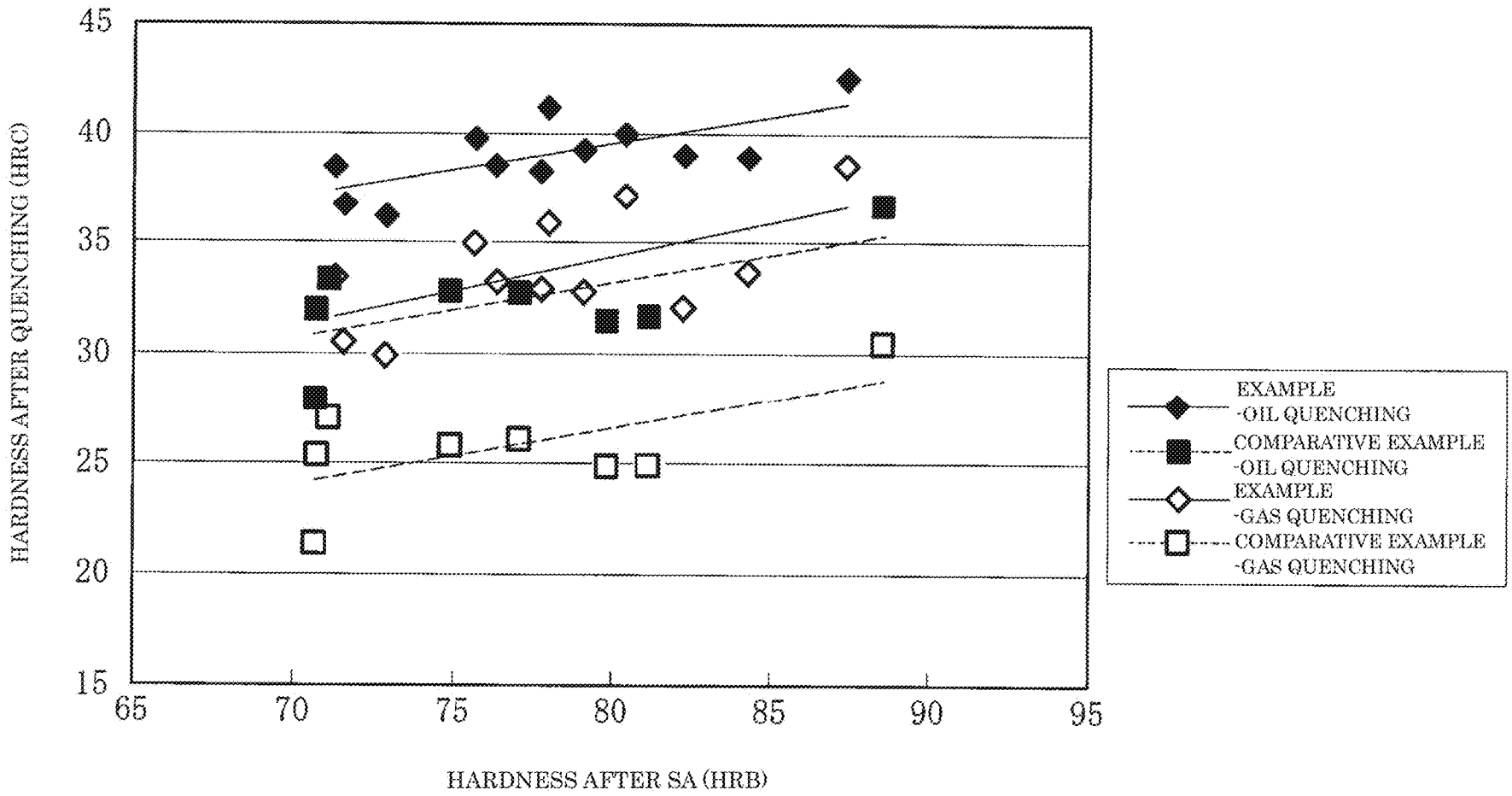
FIG. 4 is a diagram showing a relationship between hardness after spheroidizing and hardness after quenching when oil quenching or gas quenching is performed in Examples and Comparative Examples.

The results are shown in Tables 2 and 3, and FIGS. 3 and 4.

TABLE 1

| | | Chemical composition (% by mass) | | | | | | | | | | | | | (Remainder Fe) | | Expression |
|---|---|---|---|---|---|---|---|---|---|---|---|---|---|---|---|---|---|
| | | C | Si | Mn | P | S | Cu | Ni | Cr | Mo | s-Al | Ti | Nb | Zr | T—N | B | (2) |
| Example | 1 | 0.14 | 0.69 | 0.85 | 0.004 | 0.089 | 0.34 | 0.55 | 1.65 | 0.17 | 0.029 | 0.026 | ≤0.001 | <0.001 | 0.0075 | — | $7.1 \times 10^{-8}$ |
| | 2 | 0.18 | 0.15 | 1.39 | 0.013 | 0.020 | 0.05 | 0.05 | 1.12 | 0.01 | 0.022 | 0.023 | ≤0.001 | <0.001 | 0.0077 | — | $7.0 \times 10^{-7}$ |
| | 3 | 0.18 | 0.49 | 0.80 | 0.001 | 0.033 | 0.85 | 0.07 | 1.39 | 0.20 | 0.043 | 0.071 | ≤0.001 | <0.001 | 0.0254 | — | $3.3 \times 10^{-6}$ |
| | 4 | 0.18 | 0.71 | 0.75 | 0.016 | 0.067 | 0.10 | 0.10 | 1.13 | 0.19 | 0.017 | 0.090 | ≤0.001 | <0.001 | 0.0221 | 0.005 | $3.0 \times 10^{-6}$ |
| | 5 | 0.24 | 0.28 | 1.34 | 0.026 | 0.096 | 0.36 | 0.13 | 0.10 | 0.36 | 0.025 | 0.085 | ≤0.001 | <0.001 | 0.0242 | 0.005 | $4.6 \times 10^{-7}$ |
| | 6 | 0.19 | 1.07 | 0.84 | 0.011 | 0.048 | 0.92 | 0.30 | 0.98 | 0.15 | 0.008 | <0.001 | ≤0.001 | <0.001 | 0.0280 | — | — |
| | 7 | 0.18 | 1.29 | 0.54 | 0.002 | 0.046 | 0.60 | 0.61 | 1.65 | 0.25 | 0.001 | <0.001 | ≤0.001 | <0.001 | 0.0050 | — | — |
| | 8 | 0.20 | 0.05 | 0.82 | 0.027 | 0.017 | 0.42 | 0.11 | 1.21 | 0.08 | 0.008 | 0.018 | ≤0.001 | <0.001 | 0.0062 | — | $6.7 \times 10^{-7}$ |
| | 9 | 0.21 | 0.35 | 0.65 | 0.030 | 0.049 | 0.15 | 0.80 | 0.72 | 0.39 | 0.007 | 0.104 | ≤0.001 | <0.001 | 0.0290 | — | $1.0 \times 10^{-6}$ |
| | 10 | 0.17 | 0.15 | 0.80 | 0.004 | 0.067 | 0.42 | 0.15 | 1.13 | 0.25 | 0.031 | 0.01 | ≤0.001 | 0.04 | 0.0122 | — | $2.7 \times 10^{-6}$ |
| | 11 | 0.27 | 0.59 | 0.62 | 0.014 | 0.079 | 0.48 | 0.60 | 0.95 | 0.06 | 0.014 | 0.003 | ≤0.001 | 0.13 | 0.0244 | — | $2.6 \times 10^{-6}$ |
| | 12 | 0.20 | 0.17 | 0.82 | 0.010 | 0.020 | 0.15 | 0.10 | 1.16 | 0.05 | 0.002 | <0.001 | ≤0.001 | <0.001 | 0.0050 | 0.006 | — |
| Comparative Example | 1 | 0.18 | 0.10 | 0.69 | 0.028 | 0.053 | 0.09 | 0.08 | 1.70 | 0.09 | 0.038 | 0.003 | ≤0.001 | <0.001 | 0.016 | — | $1.1 \times 10^{-5}$ |
| | 2 | 0.20 | 1.00 | 1.33 | 0.023 | 0.050 | 0.51 | 0.42 | 0.53 | 0.15 | 0.016 | 0.01 | ≤0.001 | <0.001 | 0.017 | 0.005 | $1.0 \times 10^{-5}$ |
| | 3 | 0.22 | 0.26 | 0.62 | 0.006 | 0.094 | 0.40 | 0.43 | 0.89 | 0.22 | 0.054 | 0.011 | ≤0.001 | <0.001 | 0.03 | — | $1.9 \times 10^{-5}$ |
| | 4 | 0.18 | 0.54 | 1.09 | 0.013 | 0.084 | 0.65 | 0.29 | 0.95 | 0.02 | 0.038 | 0.118 | ≤0.001 | <0.001 | 0.026 | — | $6.1 \times 10^{-6}$ |
| | 5 | 0.17 | 0.15 | 0.80 | 0.022 | 0.013 | 0.56 | 0.15 | 1.02 | 0.41 | 0.028 | 0.160 | ≤0.001 | <0.001 | 0.01 | — | $3.0 \times 10^{-5}$ |
| | 6 | 0.20 | 0.80 | 0.67 | 0.021 | 0.024 | 0.70 | 0.47 | 1.01 | 0.13 | 0.019 | 0.088 | ≤0.001 | 0.08 | 0.010 | — | $2.0 \times 10^{-5}$ |
| | 7 | 0.19 | 0.70 | 0.60 | 0.016 | 0.074 | 0.66 | 0.10 | 1.20 | 0.28 | 0.027 | 0.10 | ≤0.001 | 0.08 | 0.006 | — | $2.4 \times 10^{-5}$ |
| | 8 | 0.19 | 0.05 | 0.80 | 0.025 | 0.074 | 0.98 | 0.10 | 1.00 | 0.08 | 0.049 | 0.028 | ≤0.001 | 0.33 | 0.02 | — | $3.0 \times 10^{-5}$ |

TABLE 2

| | | Amount of precipitates (mol) | | | | | Maximum deformation | Average crystal grain size number of prior γ |
|---|---|---|---|---|---|---|---|---|
| | | TiC | AlN | ZrC | Total | DI | resistance (MPa) | after carburization |
| Example | 1 | $1.5 \times 10^{-4}$ | — | — | $1.5 \times 10^{-4}$ | 5.30 | 779 | 4.7 |
| | 2 | — | $5.1 \times 10^{-5}$ | — | $5.1 \times 10^{-5}$ | 3.79 | 761 | 4.8 |
| | 3 | — | $2.3 \times 10^{-4}$ | — | $2.3 \times 10^{-4}$ | 4.19 | 791 | 5.4 |
| | 4 | $1.0 \times 10^{-4}$ | — | — | $1.0 \times 10^{-4}$ | 3.73 | 782 | 4.6 |
| | 5 | $1.7 \times 10^{-4}$ | — | — | $1.7 \times 10^{-4}$ | 3.18 | 775 | 4.6 |
| | 6 | — | $7.9 \times 10^{-5}$ | — | $7.9 \times 10^{-5}$ | 3.81 | 766 | 5.0 |
| | 7 | — | — | — | 0 | 5.00 | 771 | 6.0 |
| | 8 | — | $1.5 \times 10^{-4}$ | — | $1.5 \times 10^{-4}$ | 3.11 | 777 | 5.1 |
| | 9 | $5.4 \times 10^{-5}$ | — | — | $5.4 \times 10^{-5}$ | 4.01 | 777 | 5.9 |
| | 10 | — | $1.3 \times 10^{-4}$ | — | $1.3 \times 10^{-4}$ | 3.93 | 764 | 4.9 |
| | 11 | — | — | $1.8 \times 10^{-4}$ | $1.8 \times 10^{-4}$ | 2.93 | 770 | 5.2 |
| | 12 | — | | | 0 | 3.01 | 763 | 4.3 |
| Comparative Example | 1 | — | $1.0 \times 10^{-3}$ | — | $1.0 \times 10^{-3}$ | 2.43 | 810 | 9.5 |
| | 2 | — | $8.0 \times 10^{-4}$ | — | $8.0 \times 10^{-4}$ | 3.11 | 799 | 8.9 |
| | 3 | — | $1.6 \times 10^{-3}$ | — | $1.6 \times 10^{-3}$ | 2.27 | 793 | 9.7 |
| | 4 | $6.0 \times 10^{-4}$ | — | — | $6.0 \times 10^{-4}$ | 2.34 | 805 | 8.1 |
| | 5 | $2.7 \times 10^{-3}$ | — | — | $2.7 \times 10^{-3}$ | 2.75 | 801 | 11.8 |
| | 6 | $4.4 \times 10^{-4}$ | $1.4 \times 10^{-3}$ | — | $1.8 \times 10^{-3}$ | 2.27 | 790 | 9.6 |
| | 7 | $1.9 \times 10^{-3}$ | $5.4 \times 10^{-4}$ | — | $2.4 \times 10^{-3}$ | 2.46 | 813 | 11.0 |
| | 8 | — | — | $2.8 \times 10^{-3}$ | $2.8 \times 10^{-3}$ | 1.78 | 784 | 10.0 |

TABLE 2-continued

| | | Amount of precipitates per grain boundary unit area (mol/mm$^2$) | Hardness after SA (HRB) | Hardness after oil quenching (HRC) | Hardness after gas quenching (HRC) |
|---|---|---|---|---|---|
| Example | 1 | $3.8 \times 10^{-10}$ | 80.5 | 40.0 | 37.2 |
| | 2 | $1.2 \times 10^{-10}$ | 76.4 | 38.5 | 33.2 |
| | 3 | $4.4 \times 10^{-10}$ | 75.7 | 39.8 | 34.9 |
| | 4 | $2.6 \times 10^{-10}$ | 77.8 | 38.3 | 32.9 |
| | 5 | $4.3 \times 10^{-10}$ | 79.1 | 39.3 | 32.8 |
| | 6 | $1.8 \times 10^{-10}$ | 84.3 | 39.0 | 33.6 |
| | 7 | 0 | 87.4 | 42.5 | 38.6 |
| | 8 | $3.3 \times 10^{-10}$ | 71.5 | 36.7 | 30.5 |
| | 9 | $9.0 \times 10^{-11}$ | 78.0 | 41.2 | 35.9 |
| | 10 | $3.0 \times 10^{-10}$ | 71.3 | 38.5 | 33.4 |
| | 11 | $3.8 \times 10^{-10}$ | 82.3 | 39.1 | 32.1 |
| | 12 | 0 | 72.9 | 36.2 | 29.9 |
| Comparative Example | 1 | $4.7 \times 10^{-10}$ | 70.7 | 32.0 | 25.4 |
| | 2 | $4.6 \times 10^{-10}$ | 88.5 | 36.7 | 30.5 |
| | 3 | $7.0 \times 10^{-10}$ | 74.9 | 32.8 | 25.8 |
| | 4 | $4.6 \times 10^{-10}$ | 79.8 | 31.5 | 24.9 |
| | 5 | $5.7 \times 10^{-10}$ | 71.1 | 33.3 | 27.1 |
| | 6 | $8.2 \times 10^{-10}$ | 81.2 | 31.7 | 25.0 |
| | 7 | $6.7 \times 10^{-10}$ | 77.1 | 32.8 | 26.1 |
| | 8 | $1.1 \times 10^{-9}$ | 70.6 | 27.9 | 21.4 |

TABLE 3

| Crystal grain size at carburization at 1,050° C. | |
|---|---|
| Example | Average crystal grain size number of prior γ after carburization |
| 1 | 4.3 |
| 6 | 4.8 |
| 11 | 4.8 |

The "T-N" represents the total amount of nitrogen.

As shown in the results of Tables 1 and 2, in all Comparative Examples, the value of expression (2) does not satisfy the condition of the above-mentioned [5], and the total amount of TiC, AlN and ZrC which are precipitate particles, is as large as more than $4.5\times10^{-10}$ moles per grain boundary unit area of prior austenite grains after carburization.

In all Comparative Examples, the average crystal grain size number of prior austenite grains after carburization is No. 8 or more, that is, the crystal grains are fine, and the value of maximum deformation resistance at the time of cold forging is large. That is, cold forgeability is not satisfactory.

On the other hand, in all Examples, the value of the expression (2) satisfies the condition of the above-mentioned [5] and the total amount of TiC, AlN and ZrC, which are precipitate particles, is as small as $4.5\times10^{-10}$ moles or less per grain boundary unit area of prior austenite grains after carburization.

In all Examples, the average crystal grain size number of prior austenite grains after carburization is No. 6 or less, that is, the crystal grains are large. Thus, due to the large crystal grains, the value of maximum deformation resistance $\sigma_{MAX}$ of compression at the time of cold forging is as small as 800 (MPa) or less and satisfactory cold forgeability is exhibited.

Incidentally, FIG. 3 shows a relationship between a DI value on the horizontal axis and the maximum deformation resistance $\sigma_{MAX}$ on the vertical axis in Examples and Comparative Examples in Table 2.

From this figure, it is found that the maximum deformation resistance is small under the same DI value in Examples as compared to Comparative Examples. Alternatively, it is found that the DI value is high under the same maximum deformation resistance $\sigma_{MAX}$.

In this figure, in all Examples, the value of $\sigma_{MAX}$ is smaller than 12.8×DI+745 and the relationship between the DI value and the $\sigma_{MAX}$ value satisfies the relationship of the expression (1).

In contrast, in Comparative Examples, the value of $\sigma_{MAX}$ is larger than 12.8×DI+745 and does not satisfy the relationship of the expression (1).

That is, in all Comparative Examples and Examples, when the DI value increases, the value of $\sigma_{MAX}$ increases according to the increase in the DI value. However, in Comparative Examples, the level of the value of $\sigma_{MAX}$ is high as compared to Examples, and when hardenability increases, while the value of $\sigma_{MAX}$ is maintained at a high level, the value of $\sigma_{MAX}$ further increases. Thus, it is difficult to perform cold forging while maintaining high hardenability. On the other hand, in Examples, it is found that hardenability can be effectively increased while ensuring satisfactory cold forgeability.

FIG. 4 shows a relationship between the hardness after spheroidizing and the hardness after carburizing and quenching using oil quenching or gas quenching in each of Examples and Comparative Example.

From the results of FIG. 4, it is found that the hardness after carburizing and quenching using gas quenching in Examples is almost the same as the hardness after carburizing and quenching using oil quenching in Comparative Examples.

Although the embodiments of the present invention have been described above, the embodiments are merely examples and embodiments to which various changes are applied within a range not departing from the gist of the present invention can be realized.

INDUSTRIAL APPLICABILITY

According to the present invention, it is possible to provide a case hardening steel which has an excellent cold forgeability, and is capable of improving required hardenability to make carburizing and quenching by gas cooling possible, and a carburized part using the same.

While the present invention has been described in detail and with reference to specific embodiments thereof, it will be apparent to one skilled in the art that various changes and modifications can be made therein without departing the spirit and scope thereof.

The present application is based on Japanese Patent Application No. 2014-016210 filed on Jan. 30, 2014, the contents of which are incorporated herein by reference.

DESCRIPTION OF REFERENCE NUMERALS AND SIGNS p Pinning particle
q Crystal grain
Q Giant crystal grain
10 Test piece
12A, 12B Forging die

The invention claimed is:

1. A carburized part obtained by working a case hardening steel into a shape of a part by cold forging, followed by subjecting to carburizing and quenching, the case hardening steel satisfying the following Expression (1) representing a maximum deformation resistance $\sigma_{MAX}$ in MPa and a DI value, the maximum deformation resistance $\sigma_{MAX}$ in MPa being obtained when a test piece which has a size of ϕ 15×22.5 mm and is cut out from a material after spheroidizing, is subjected to compressive deformation by cold forging at a compression ratio of 70% in a state that an end surface thereof is restrained, and the DI value being obtained from a Jominy quenching test:

$$\sigma_{MAX}<12.8\times DI+745 \quad \text{Expression (1)},$$

wherein a total amount of TiC, AlN and ZrC, which are precipitate particles, is $4.5\times10^{-10}$ moles or less per 1 $mm^2$ of grain boundary area of prior austenite grains after the carburizing and quenching, and the case hardening steel having a composition consisting essentially of, in terms of % by mass:

0.10% to 0.30% of C;
0.01% to 1.50% of Si;
0.40% to 1.50% of Mn;
0.01% to 0.10% of S;
0.03% or less of P;
0.05% to 1.00% of Cu;
0.05% to 1.00% of Ni;
0.01% to 1.39% of Cr;
0.01% to 0.50% of Mo;
0.001% or less of Nb;
0.005% to 0.050% of s-Al;
0.005% to 0.030% of N;
0.001% to 0.150% of Ti; and
0.000% to 0.300% of Zr,
and optionally: 0.001% to 0.010% of B,
with the remainder being Fe and inevitable impurities, wherein [Ti], [Zr] and [N] which respectively represent contents of Ti, Zr and N satisfy the following Expression (2):

$$|[Ti]/47.9+[Zr]/91.2+[N]/14|/100\leq3.5\times10^{-6}\ \text{mol/g} \quad \text{Expression (2)},$$

wherein, in a structure thereof after the carburizing and quenching, an average crystal grain size number of the prior austenite grains is No. 5.9 or less.

2. The carburized part according to claim 1, wherein the carburizing and quenching is carburizing and quenching performed using gas quenching.

3. A carburized part obtained by working a case hardening steel into a shape of a part by cold forging, followed by subjecting to carburizing and quenching, the case hardening steel satisfying the following Expression (1) representing a maximum deformation resistance $\sigma_{MAX}$ in MPa and a DI value, the maximum deformation resistance $\sigma_{MAX}$ in MPa being obtained when a test piece which has a size of ϕ 15×22.5 mm and is cut out from a material after spheroidizing, is subjected to compressive deformation by cold forging at a compression ratio of 70% in a state that an end surface thereof is restrained, and the DI value being obtained from a Jominy quenching test:

$$\alpha_{MAX}<12.8\times DI+745 \quad \text{Expression (1)},$$

wherein a total amount of TiC, AlN and ZrC, which are precipitate particles, is $4.5\times10^{-10}$ moles or less per 1 $mm^2$ of grain boundary area of prior austenite grains after the carburizing and quenching, and the case hardening steel having a composition consisting essentially of, in terms of % by mass:

0.10% to 0.30% of C;
0.01% to 1.50% of Si;
0.40% to 1.50% of Mn;
0.01% to 0.10% of S;
0.03% or less of P;
0.05% to 1.00% of Cu;
0.05% to 1.00% of Ni;
0.01% to 1.39% of Cr;
0.01% to 0.50% of Mo;
0.001% or less of Nb;
0.001% to 0.008% of s-Al;
0.005% to 0.030% of N;
less than 0.001% of Ti; and
less than 0.001% of Zr,
and optionally: 0.0010% to 0.0100% of B,
with the remainder being Fe and inevitable impurities, wherein, in a structure thereof after the carburizing and quenching, an average crystal grain size number of the prior austenite grains is No. 5.9 or less.

* * * * *